US006481810B1

(12) United States Patent
Kirchhoff

(10) Patent No.: US 6,481,810 B1
(45) Date of Patent: Nov. 19, 2002

(54) HEAT SEALING GARBAGE CABINET

(76) Inventor: Robert W. Kirchhoff, 1N615 Ingalton, West Chicago, IL (US) 60185

( * ) Notice: Subject to any disclaimer, the term of this patent is extended or adjusted under 35 U.S.C. 154(b) by 0 days.

(21) Appl. No.: 10/000,003

(22) Filed: Dec. 4, 2001

(51) Int. Cl.[7] ..... A47B 88/00

(52) U.S. Cl. ..... 312/276; 312/321.5; 221/495.08; 248/99

(58) Field of Search ..... 312/234, 321.5, 312/275, 276; 248/99, 100, 101; 141/10; 53/373.7, 374.8, 374.9; 220/263, 284, 495.08

(56) References Cited

U.S. PATENT DOCUMENTS 3,323,714 A * 6/1967 Lewis ..... 248/99
3,653,619 A * 4/1972 Plum ..... 248/99
3,817,448 A * 6/1974 Schneider ..... 248/99
3,836,037 A * 9/1974 Bass ..... 248/99
5,092,105 A * 3/1992 Bish-Shin ..... 53/373.7
5,125,526 A * 6/1992 Sumanis ..... 220/263
5,349,996 A * 9/1994 McGregor ..... 141/10

* cited by examiner

*Primary Examiner*—Lanna Mai
*Assistant Examiner*—Jerry A. Anderson

(57) ABSTRACT

A heat sealing garbage cabinet stores a plastic bag of garbage. When the bag is but partially full, the bag is temporarily sealed by folding and pressure sealing the top of the bag. When the bag is full, it is heat sealed. A slitter unit cuts a handle-hole in the bag for easy disposal.

9 Claims, 5 Drawing Sheets

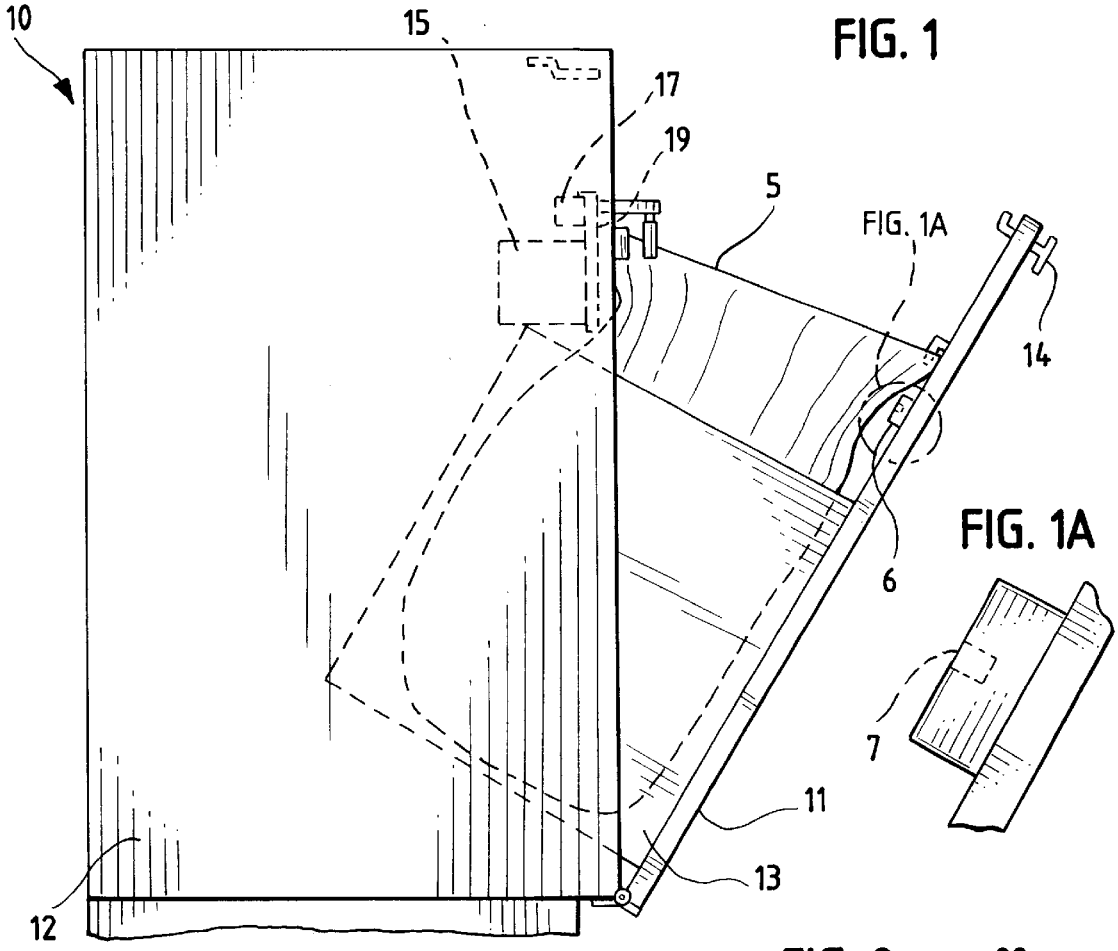
FIG. 1
FIG. 1A
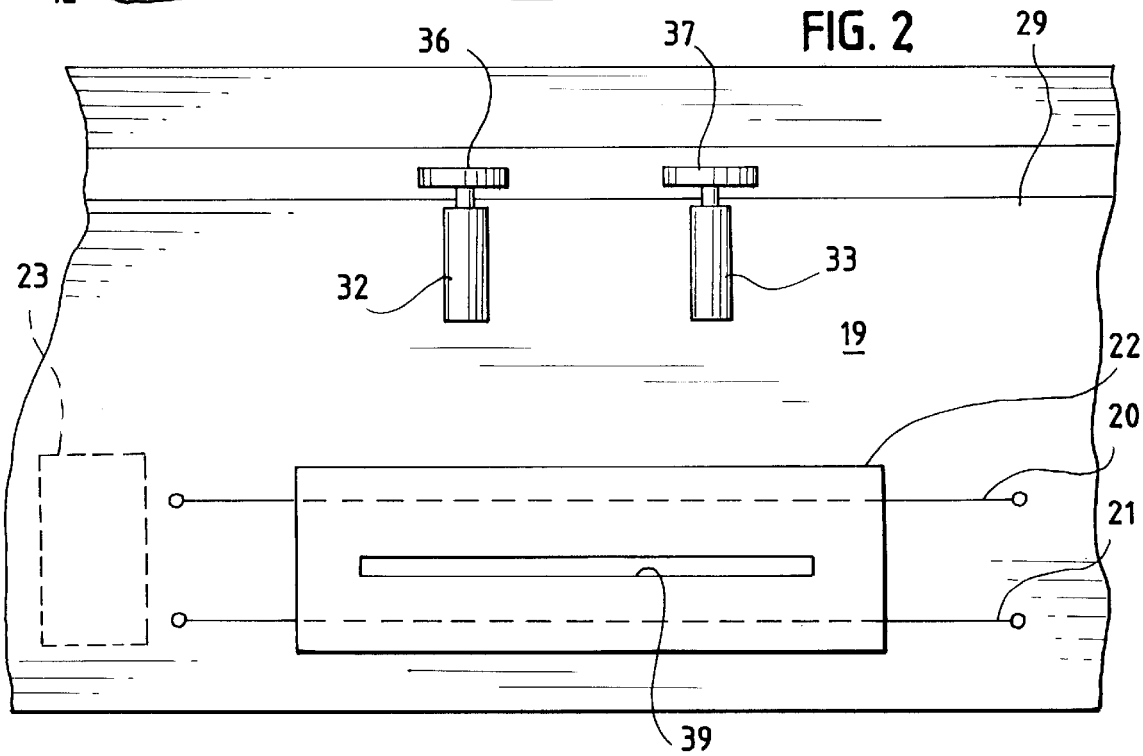
FIG. 2

HEAT SEALING GARBAGE CABINET

BACKGROUND OF THE INVENTION

Garbage can attract insects, roaches, rodents and, other vermin, both indoors and outdoors. It can be a breeding place for disease causing bacteria. Noxious, foul odors can emanate from it, especially if the garbage is ripe. Maximum containment with minimum handling is preferable for hazardous waste, such as medical waste. At the very least, garbage is unsightly and dirty. Therefore it is desirable to keep garbage out of sight and render it as innocuous as possible.

SUMMARY OF THE INVENTION

This invention relates to garbage handling and disposal. It is an object of the invention to render garbage inoffensive and innocuous by keeping it out of sight in a cabinet and sealed at all times. Garbage is kept in a plastic bag in the cabinet of the present invention. Upon opening the cabinet, the bag opens for insertion of garbage. Upon closing the cabinet door, a pleating unit folds or pleats the top of the bag. When the bag is but partially full, a heat sealing unit mounted across the front of the cabinet and an elastomeric strip mounted on the door combine to subject the bag to sealing pressure between mating surfaces when the door is securely latched. When the bag is full, the heat sealing unit permanently seals the bag. Additionally, a slitting unit may be employed to cut a handle-hole near the top of the bag for ease in carrying the bag when it is removed from the cabinet and disposed of.

BRIEF DESCRIPTION OF THE DRAWINGS

FIG. 1 shows the heat sealing cabinet from the side.

FIG. 1A is an enlarged portion of FIG. 1.

FIG. 2 is a frontal view of the heat sealing and slitting units (combined), and the pleating unit.

DETAILED DESCRIPTION OF THE INVENTION

Figure 3A:
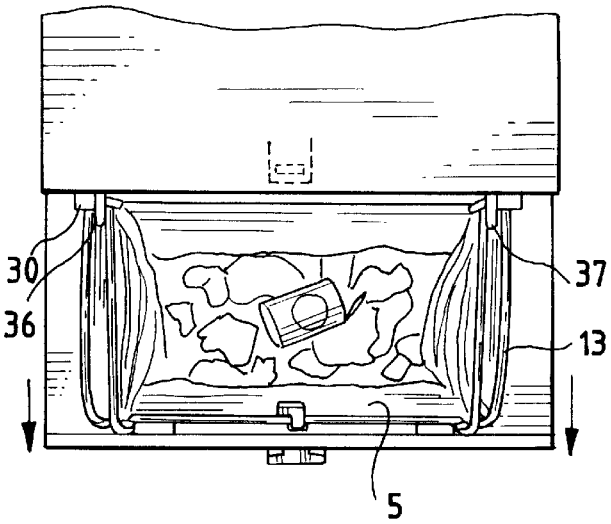
FIGS. 3A–C demonstrate the bag pleating operation.

Referring to FIG. 1, plastic bag 5 is contained inside of cabinet 10 when cabinet door 11 is closed against cabinet body 12. The term "cabinet body" is used herein to refer to the left portion of the cabinet in the drawing, i.e., the entire cabinet excluding the cabinet door. Variations is cabinet construction are held to be within the scope of the invention, for example, a "top loader," it being a trivial matter to arrange different mechanical linkages to accomplish the several functions of the invention.

A drip container 13 that is attached to and pivots outward with the cabinet door may be employed to support the garbage bag and catch any drippings from a bag that develops a hole. When cabinet door 11 is closed and latched by means of latch 14, the top of the plastic bag is subjected to pressure between the frontal plate 19 which stretches across the cabinet opening and an opposing mating surface such as elastomeric strip 6 and thereby sealed. Referring to FIG. 1A, the elastomeric strip has a slot 7 cut in it to receive a knife blade that cuts a handle hole in the bag when it is time to dispose of the bag. The relationship of the slitting knife and the elastomeric sealing strip are seen more clearly in FIG. 8.

The latch 14 is preferably of the type that forces the door against the cabinet body with some pressure when the latch handle is turned, either by wedging action or screw action. While a drip container 13 is shown in this embodiment of the invention, a sliding drawer could also be used to contain the garbage bag.

Heat sealing is a highly desirable final step in the process of sealing gargage, to which end a heat sealing and slitting assembly 15 is mounted on frontal plate 19.

Figure 3B:
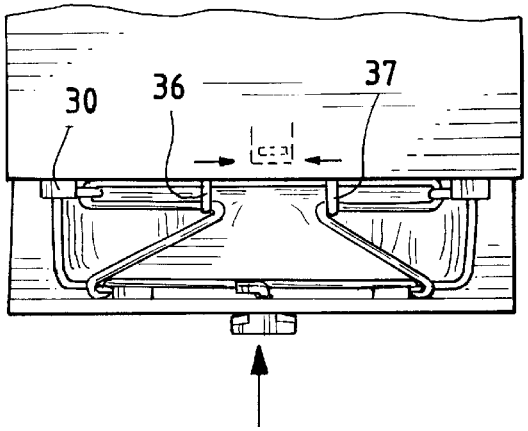
Figure 3C:
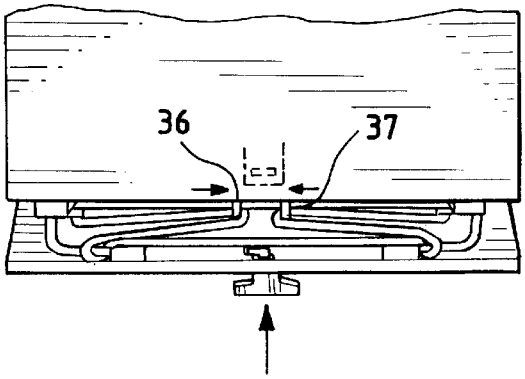

Pleating unit 17 pleats or folds the top of the bag before the door is closed, as shown in FIGS. 3A–C. This confers several advantages. Otherwise the cabinet and the mating sealing surfaces would have to be excessively wide. It is also much more difficult to apply even pressure over a wide area than a small area. Also, a slit cut in the top of the bag through several plies of plastic for a handle-hole provides greater strength for carrying the bag to final disposal.

Referring to FIG. 2, the heat sealing unit comprises two heating wires 20 and 21, which are covered by fiberglass tape 22. An electrical timer such as time delay relay 23 provides timed heating for heat sealing. The heating wires and fiberglass tape are mounted across the front of the frontal plate 19. The relay is, of course, mounted elsewhere in a suitable location, but makes electrical contact with the wires, for ex., through holes in the frontal plate. Depending on the composition of plate 19, an additional layer of insulating fiberglass tape may be applied between the heating wires and frontal plate. Any heater that is flat enough to provide a surface against which the bag can be compressed and sealed can be employed in the present invention, or alternatively the opposing surface may be shaped to conform to the shape of the heater, if necessary for a good seal. Elastomeric strip 6 of FIG. 1 forces the bag against the taped-over heating wires when the cabinet door is closed, for pressure sealing when the bag is partially full and for heat sealing when the bag is full.

The operation of the pleating unit is best seen in the several drawings FIGS. 2, 3A–C, 4, and 5.

Referring to FIG. 3A, The top of bag 5 is held securely at four points by suitable fastening means such as snap-action bag holder 30 (described fully later in the specification). When the cabinet door is fully opened, as in FIG. 3A, rollers 32 and 33 (FIGS. 2, 4, and 5) are at their outermost position. Rollers 32 and 33 descend from roller plates 36 and 37 that pass through a slot-defining portion 29 (FIG. 2) of frontal plate 19. As the door is closed, the rollers pull in the sides of the bag. FIG. 3B shows the bag partially folded or pleated, and in FIG. 3C the bag is almost fully pleated. Other folded configurations are of course within the perview of the present invention.

Figure 4:
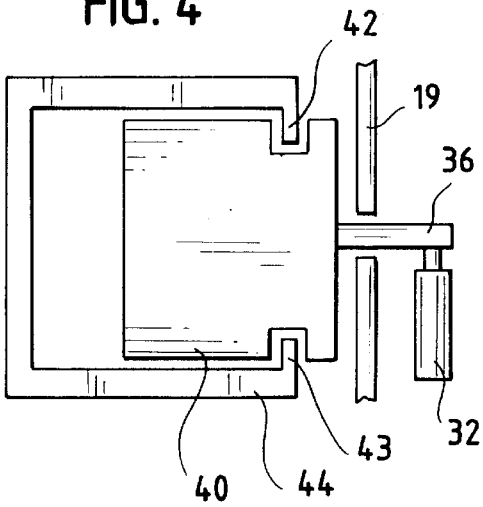
FIG. 4 is a side view of the bag pleating unit.
Figure 5:
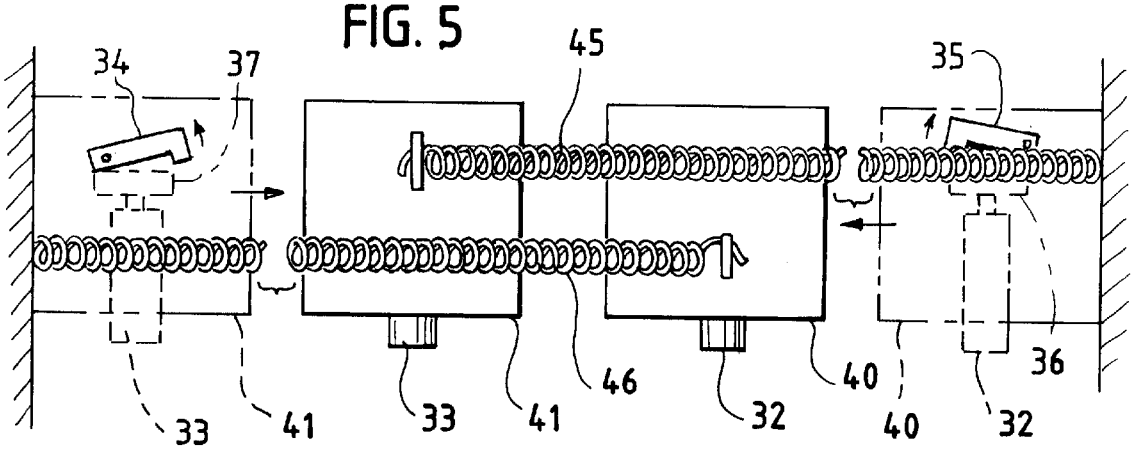
FIG. 5 is a view of the bag pleating unit from the back.

Referring to FIGS. 4 and 5, The rollers 32 and 33 are guided in their lateral motion by suitable means, such as guide blocks 40 and 41, which have keyways in them that engage the ends 42 and 43 of guide channel bar 44. Springs 45 and 46 pull the guide blocks, and thus the rollers, to their center most position as the cabinet door is closed, thus pleating the bag. FIG. 5 shows the blocks in both their outer and inner positions. In the outer position, the blocks may be held by roller plate latches such as 34 and 35 for ease of loading a garbage bag into the apparatus. These latches engage the roller plates 36 and 37 and pivot on the frontal plate 19.

Figure 6A:
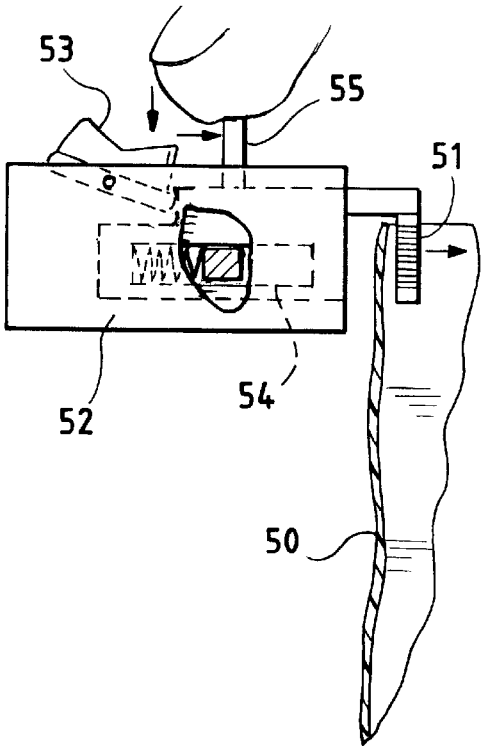
FIGS. 6A and 6B are views of the snap-action bag holding unit, partially cut away.
Figure 6B:
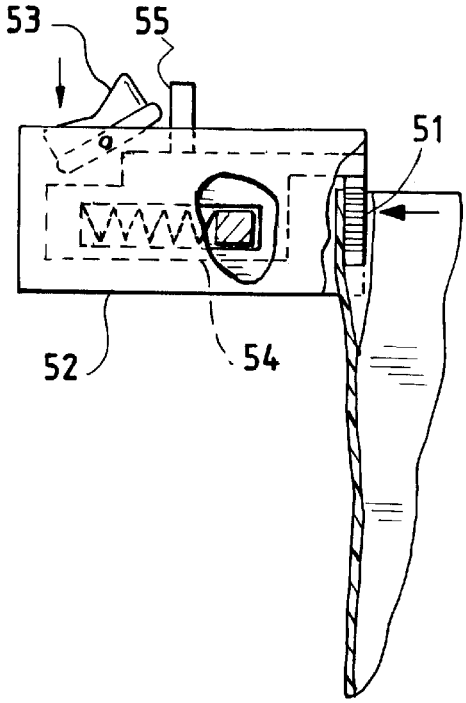

FIGS. 6A and 6B show the snap-action bag holders which are used to secure the bag to the cabinet and its door. A top portion 50 of the bag is inserted between holding finger 51, preferably ridged or knurled for holding power, and the body 52 of the bag holder. When lever 53 is depressed, spring-loaded sliding block 54 pulls holding finger 51 and the bag portion 50 into a recess in the body 52 to securely hold it. Handle 55 is used to restore the holding finger to its open position.

Figure 7:
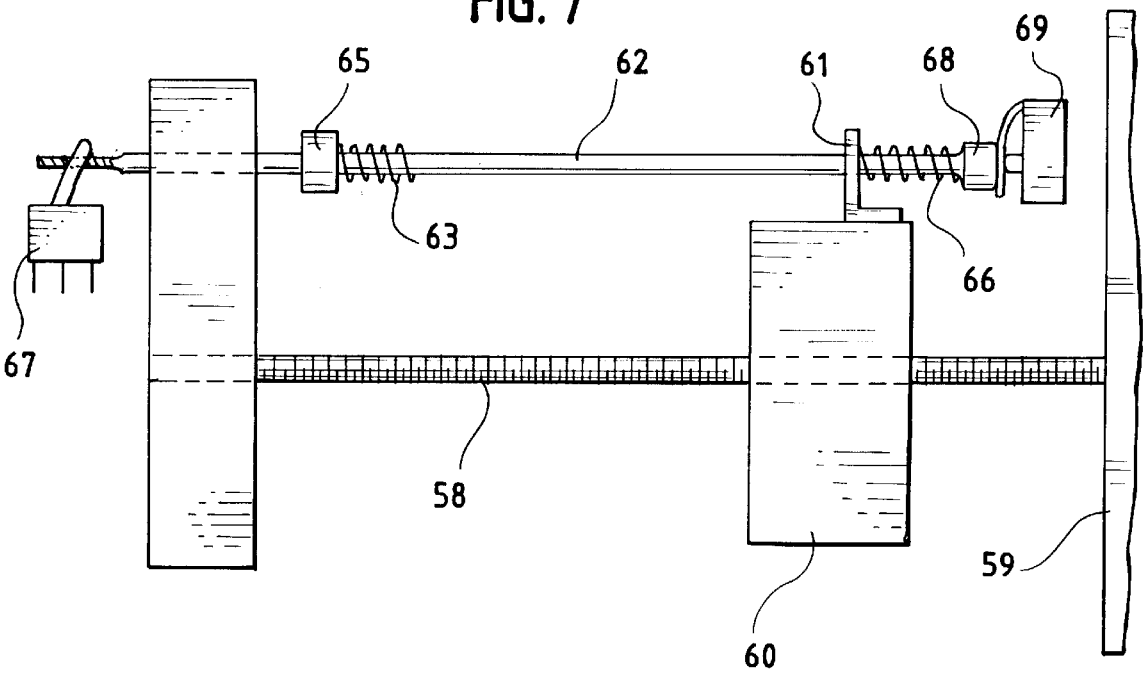
FIG. 7 shows the bag slitter unit from the back.
Figure 8:
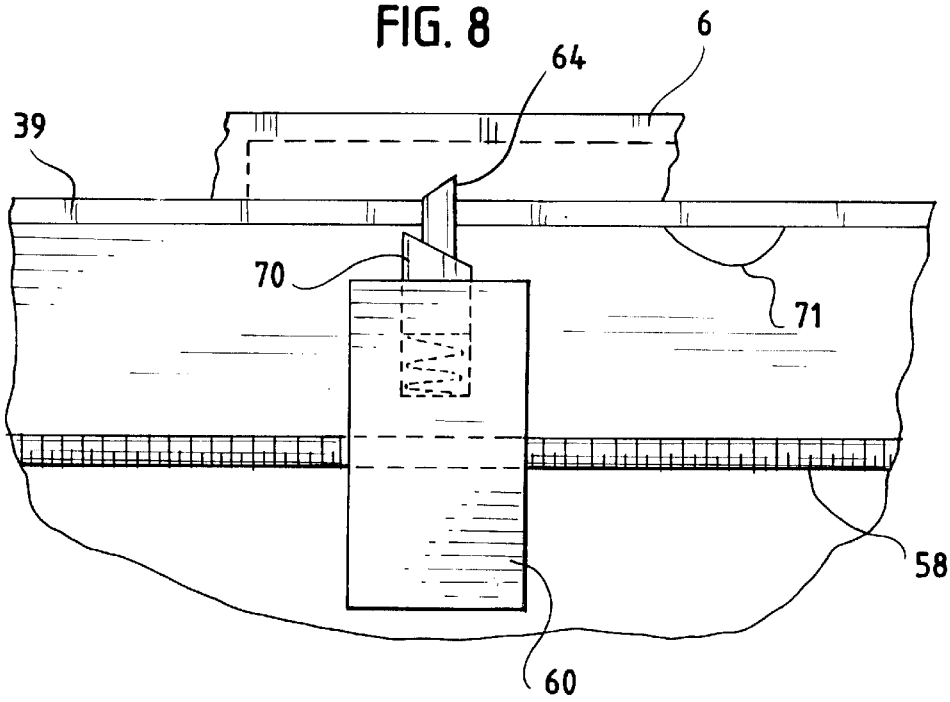
FIG. 8 is a top view of the same.

FIGS. 7 and 8 show the slitter mechanism. Screw drive 58, driven by reversible motor 59, engages slitter block 60, moving it back and forth. Switch pusher plate 61 is attached to slitter block 60. Floating switch actuator rod 62 passes through plate 61. Retractable knife 64 passes through a slot portion 39 cut in frontal plate 19, as can be seen in FIGS. 2 and 8. Reference numeral 39 points to the lower surface of this slot.

Slitter block 60 is first driven to the left to cut a handle-hole in the bag. When plate 61 hits a reversing limit block 65 (preferably through a spring such as 63 to cushion the operation), the switch actuator rod 62 flips an SPDT reversing switch 67 to its alternate circuit to reverse the motor.

In the reverse direction (to the right in the drawing), when pusher plate 61 begins to push against spring 66, the reversing switch 67 is forced back to its starting position for the next cycle. Power for the motor is supplied from a holding relay, so the slitter block continues moving to the right in the drawing. As pusher plate 61 continues to the right, limit switch 69 is forced to its off (depressed) position by a second limit block 68 to terminate the electrical operation. At this point, slitter block 60 is at its "home" position ready for another cycle. In its home position, the slitter knife 64 is retracted for safety. In FIG. 8, knife holder 70 has an inclined surface that engages a pushing block 71 mounted on the frontal plate that pushes the knife holder back into its recessed position in the slitter block.

Figure 9:
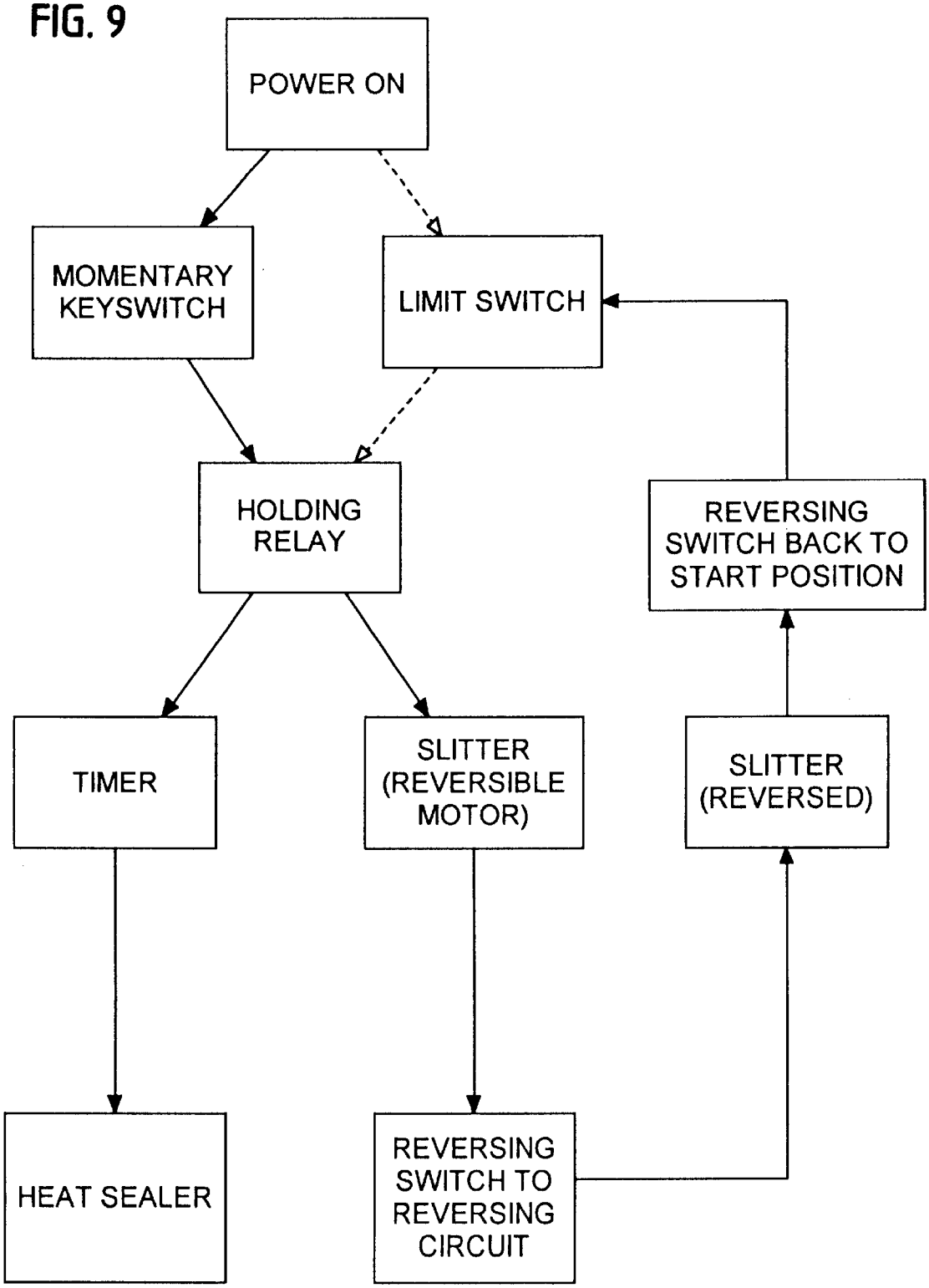
FIG. 9 is a block diagram showing the sequence of electrical control events.

FIG. 9 is a block diagram of the electrical operation. With power on, a momentary key switch is turned on, and latches a holding relay (also called a "latching" or "locking relay"), which supplies power for a complete cycle of heat sealing and slitting. This starts an electrical timer such as a time delay relay that turns on the heat sealer for sufficient time to seal the bag. At the same time the reversible motor starts moving towards reversing switch 67 to cut the bag handle-hole.

Limit switch 69 is initially off when slitter block 60 is in its home position, so the momentary switch must be held for an instant until switch 69 closes to maintain latching current to the holding relay. This alternate path is indicated by the dashed arrows in FIG. 9.

When SPDT switch 67 is flipped to its alternate circuit, this reverses the reversible motor. When slitter block 60 reaches limit switch 69, this switch is turned of, turning off latching current to the holding relay and bringing the operating cycle back to its initial state.

I claim:

1. A cabinet for plastic garbage bags which comprises:

a cabinet body;

a cabinet door;

a means for temporarily sealing a garbage bag mounted in the cabinet including a frontal plate mounted across an open side of the cabinet which is adjacent to a mating surface attached to the cabinet door when the door is closed for temporary sealing;

means for permanently sealing a garbage bag mounted in the cabinet including a heating element mounted on the frontal plate between the frontal plate and a top of a garbage bag, said heating element is flat enough not to disturb a pressure sealing provided to the garbage bag by the frontal plate when adjacent to the opposing mating surface attached to the cabinet door; and a timer regulating the amount of energy delivered to the heating element for permanently heat sealing the bag.

2. The cabinet of claim 1, wherein the heating element comprises two heating wires disposed horizontally across the frontal plate.

3. The cabinet of claim 1, wherein fastening means attach the bag at two points to the cabinet body and at two points to the cabinet door so that opening the door opens the garbage bag; and wherein the bag is pleated prior to being subjected to sealing pressure by:

a. the frontal plate extending across the cabinet opening, said frontal plate having a horizontal slot; and b. a pair of downward descending rollers that engage an outside top edge of the garbage bag, said rollers descending from roller plates (36), (37) that pass through the slot in the frontal plate and are attached to guide blocks that move laterally and are spring loaded to pull the top edge of the bag into a pleated configuration when the cabinet door is closed.

4. The cabinet of claim 3, further comprising roller plate latches to hold the rollers in outer positions for convenience in loading a garbage bag into the cabinet.

5. The cabinet of claim 3, wherein the bag is fastened to the cabinet body and door by snap-action bag holders, each of which comprises:

a holding finger that engages the top edge of the bag;

a spring-loaded sliding block, connected to said holding finger;

a lever for releasing said sliding block, whereupon the holding finger pulls the top edge of the bag into a recess in the bag holder and thereby secures a bag in place; and a handle to restore the sliding block to a starting position.

6. The cabinet of claim 2, further comprising means for slitting a handle-hole near the top of the bag.

7. The cabinet of claim 6, wherein the slitting means comprises:

a frontal plate having a horizontally disposed slit between heating wires for a bag cutting knife to pass through;

said knife being retractably mounted to a slitter block (60);

said slitter block being engaged by a threaded drive and being driven back and forth by a reversible motor which turns the threaded drive, thus directing the knife in the cutting of a handle-hole in the garbage bag.

8. A cabinet for plastic garbage bags which comprises:

a cabinet body;

a cabinet door or sliding drawer;

a first mating surface of a frontal plate mounted on the cabinet body and a second mating surface attached to the cabinet door or sliding drawer, said mating surfaces coming together when the door or the drawer is closed to apply a sealing pressure to a top of a garbage bag; and wherein the bag is fastened at two points to the cabinet body and at two points to the cabinet door or sliding drawer by fastening means so that opening the door or drawer opens the garbage bag; and wherein the bag is pleated prior to being subjected to sealing pressure by:

a. the frontal plate extends across the cabinet opening, said frontal plate having a horizontal slot;

b. a pair of downward descending rollers that engage an outside top edge of the garbage bag, said rollers descending from roller plates (36), (37) that pass through the slot in the frontal plate and are attached to guide blocks that move laterally and are spring loaded to pull the top edge of the bag into a pleated configuration when the cabinet door is closed.

9. The cabinet of claim 8, wherein the bag is fastened to the cabinet body and door or sliding drawer by snap-action bag holders, each of which comprises:

a holding finger that engages the top edge of the bag;

a spring-loaded sliding block, connected to said holding finger;

a lever for releasing said sliding block, whereupon the holding finger pulls the top edge of the bag into a recess in the bag holder and thereby secures the bag in place; and a handle to restore the sliding block to a starting position.

* * * * *